US005341433A

United States Patent [19]

Meyer et al.

[11] Patent Number: 5,341,433

[45] Date of Patent: Aug. 23, 1994

[54] HEARING AID DEVICE

[75] Inventors: Wolfram Meyer, Moehrendorf; Joseph Sauer, Strullendorf, both of Fed. Rep. of Germany

[73] Assignee: Siemens Aktiengesellschaft, Munich, Fed. Rep. of Germany

[21] Appl. No.: 988,973

[22] Filed: Dec. 10, 1992

[30] Foreign Application Priority Data

Dec. 17, 1991 [EP] European Pat. Off. ..... 91121598.6

[51] Int. Cl.[5] ..... H04R 25/00

[52] U.S. Cl. ..... 381/69; 381/68; 381/68.7

[58] Field of Search ..... 381/69, 69.2, 68.6, 381/68.7, 68, 68.2, 68.4; 338/99; 200/52 R

[56] References Cited

U.S. PATENT DOCUMENTS 4,199,637 4/1980 Sado .
4,638,125 1/1987 Buettner ..... 381/68.7
4,679,240 7/1987 Heide .
4,783,815 11/1988 Büttner ..... 381/68.7
4,810,992 3/1989 Eventoff .
4,955,729 9/1990 Marx .
4,963,702 10/1990 Yaniger et al. .
5,053,585 10/1991 Yaniger .

FOREIGN PATENT DOCUMENTS 3623906 1/1988 Fed. Rep. of Germany .
3840393 6/1989 Fed. Rep. of Germany .
8806161.2 10/1989 Fed. Rep. of Germany .
WO87/06422 10/1987 PCT Int'l Appl. .

*Primary Examiner*—Curtis Kuntz
*Assistant Examiner*—Huyen D. Le
*Attorney, Agent, or Firm*—Hill, Steadman & Simpson

[57] ABSTRACT

For a simplified construction of a hearing aid device with respect to switch, control and regulating elements, one or more pressure or pressure and position sensors, which are constructed in a film-like structure to react with variable resistance, are composed of laminated polymer layers wherein one layer is coated with interdigital electrodes and the appertaining other layer is coated with semiconductor material. The sensor elements are arranged on either the outside or inside of the housing or can be arranged on a structural member, such as a carrier situated within the housing. The sensor or sensor elements, respectively, can be fashioned as part of the switches or as regulators for the operation of the device.

18 Claims, 2 Drawing Sheets

HEARING AID DEVICE

BACKGROUND OF THE INVENTION

The present invention is directed to a hearing aid device comprising a housing containing electrical components, such as a microphone, amplifier, earphone, power source, on/off switch, control elements or the like.

German OS 36 23 906 discloses a hearing aid whose components in the inside of the hearing aid housing are contacted with at least one printed circuit board. In order to be able to avoid soldering the components to the printed circuit board, the printed circuit board itself is constructed at least partially resiliently, whereby the components to be fastened are releasably held in a contacting fashion between the resilient parts of the printed circuit board and a cooperating member. An elastic contact pillow composed of an elastic silicone mat with parallel through metal threads embedded therein can thereby be provided between the printed circuit board and the cooperating member so that the upper ends of the metal threads touch the contact legs of the component and the lower ends of the metal threads will touch the interconnects of the printed circuit board when the pillow is compressed. Contact is, thus, produced between the component and the printed circuit board.

In order to simplify the wiring of electrical components in a hearing aid device, German Gebrauchsmuster G 88 06 161 discloses at least one part of the wiring which is arranged on the inside of the housing shell. A cable tree with terminals can thereby be laid on the inside of the housing shell or at least sections of the inside can comprise an electrically conductive coating.

Copending U.S. patent application Ser. No. 07/808,534, which issued as U.S. Pat. No. 5,265,168 on Nov. 23, 1993 and which claims priority from European Patent Application 90 124 629.8, is directed to a hearing aid having at least one microphone, an amplifier means, an earphone and a current source, as well as having components fashioned as controls, switches or regulating elements that are contacted with at least one printed circuit board on the inside of the hearing aid housing. An anisotropic, electrically conductive, plate-shaped, foil-shaped or mat-shaped member composed of an electrically insulating matrix material having a plurality of electrically conductive fibers that are aligned perpendicular to the plane of the plate, foil or mat and are uniformly distributed in the mat is arranged in between the interconnects of the printed circuit board and the contacts of the components that can be secured to the printed circuit board. The controls and/or potentiometers and/or switches are arranged at the printed circuit board upon employment of the anisotropic member as a contact element. As a result of this arrangement, the electrical connections between the components are intended to be assembly-friendlier and capable of being produced without soldering processes, whereby the components are secured in an easily interchangeable way and the structure of the switches and potentiometers themselves are simplified. U.S. Pat. No. 4,199,637, which corresponds to German B 26 52 683, discloses the anisotropic, electrically conductive member that is provided.

In hearing aids, finally, the employment of sensor pins is known for controlling the volume via a sensor circuit (see, for example WO 87/06422, which corresponds to European Published Application 0 241 594). U.S. Pat. No. 4,955,729, which claims priority from several German Applications including German 37 16 162, discloses a hearing aid which has sensor switches which will respond to condition changes so that when putting an in-the-ear hearing aid on or taking it off, the sensors will trigger the automatic turning on and turning off of the hearing aid. Other possible sensor changes are those such as temperature, light, moisture, electrically conductivity of the skin surface.

SUMMARY OF THE INVENTION

It is an object of the present invention to construct a hearing aid of the above-noted types more advantageously with respect to the switch, control and/or regulating elements in terms of the structure and operation, so that the surface-friendly, durable, unsusceptible and miniaturizable electrical components are employed.

In a hearing aid of the above-noted type, this object is achieved by employing one or more pressure sensors and/or pressure and position sensors in a film execution that reacts with variable resistance and are composed of laminated polymer layers, wherein one layer is coated with interdigital electrodes and the other layer is coated with a semiconductor material so that the sensor or sensors are arranged on the outside and/or on the inside of the housing or on the housing wall or a carrier member situated in the housing, and wherein the sensor or sensors, respectively, are constructed as switches and/or regulators.

In the hearing aid device of the present invention, the contact elements of the electrical components provided as keys, switches, slides, switch-overs, joysticks, control elements, regulators, volume control or the like, are formed by pressure sensors or, respectively, pressure and position sensors. Such a pressure sensor is a tactile sensor responding to the pressure that reacts with variable resistance. The electrical resistance decreases all the more with an increase of the pressure acting on the film execution. This pressure sensitivity is optimum for manual actuation of the switch, control and regulating elements of the hearing aid, namely both in programming or matching the hearing aid to the hearing loss of the respective patient, as well as for readjustments of the hearing aid or for controlling volume. Given a hearing aid with stored parameters for different transmission characteristics, one pressure sensor can form a switch-over means for setting the hearing aid to a specific hearing situation, for example quiet or loud environmental situations.

The pressure sensors can be fashioned dot-shaped, strip-shaped or planar as a matrix and can be arranged on a structural member, including an outside surface of the hearing aid housing, an inside surface of the hearing aid housing or an inside wall or a carrier situated in the housing, and can, by direct contact or indirect charging with a switch means, such as a pin, eccentric, cam, can form a regulator, for example a volume control or potentiometer, or respectively a switch, for example an on/off switch.

Superficially considered, pressure sensors of the type employed are film switches but, by contrast to the conventional switches, change the resistance given pressure applied in a normal direction. A finger pressure of approximately 10 g on a pressure sensor causes the resistance to linearly drop from, for example, 400 k Ohm to 40 k Ohm. These sensors are, therefore, ideally suited for touch controls, wherein semi-quantitative sensors are desired that are relatively inexpensive, thin, for example less than 0.15 mm, extremely durable, for example can withstand approximately 10,000,000 actuations, and are resistance to environmental influences. The sensors can be manufactured in sensor fields or as discrete elements. Pressure and position sensors can recognize the position and the pressure load of a single actuator applied in a normal direction, for example of a finger or of a pin along a straight line (a linear potentiometer) or on a planar surface (an XYZ pad). Dependent on the arrangement, positional resolutions of 0.05 mm can be achieved.

Pressure and position sensors, as well as film pressure and film position sensors in film execution, for example, force sensing resistors or, respectively, force and position sensing resistors, of the Interlink Electronics Incorporated of the type employed are inherently known and disclosed, for example, in U.S. Pat. Nos. 4,810,992; 4,963,702 and 5,053,585.

Other advantages and features of the invention will be readily apparent from the following description of the preferred embodiments, the drawings and claims.

DESCRIPTION OF THE PREFERRED EMBODIMENTS

Figure 1:
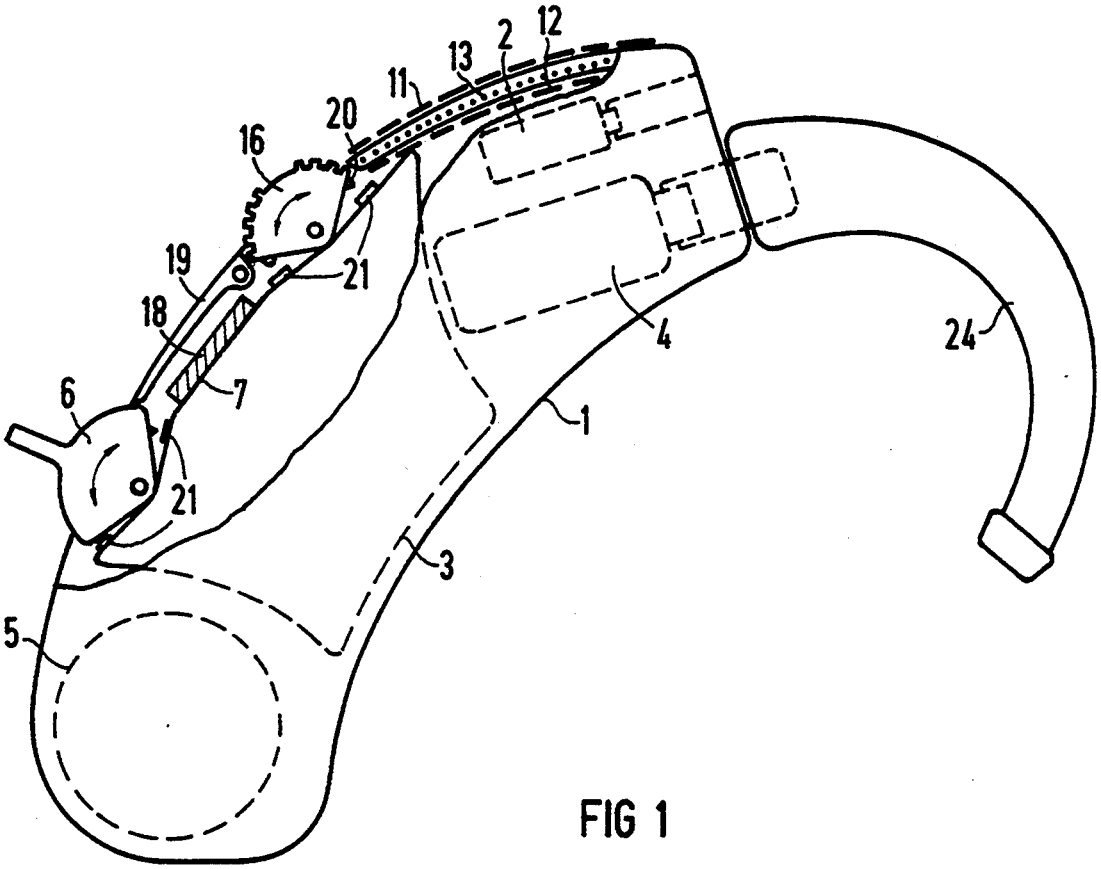
FIG. 1 is a side view of a behind-the-ear (BTE) device with portions removed and in cross sections for purposes of illustration in accordance with the present invention.

The principles of the present invention are particularly useful when incorporated in a hearing aid device in accordance with the present invention. The hearing aid device is fashioned in conformity with the invention, as illustrated as being a hearing aid device to be worn behind the ear, which is known as a BTE device. Pressure and/or pressure and position sensors 7 and 21 are provided within a housing 7 of the hearing aid. The sensors 21 are combined with switch means 6 and 16, which are mounted in the housing and are operable from outside of the housing. As illustrated, the sensors 21 are mounted on a structural member, such as a printed circuit board 3 of an amplifier or the like. The sensors can also be disposed, as illustrated by the sensor 11, on an outer surface of a housing wall 13 or can be provided on an inner surface of the housing wall 13, as indicated by position 12.

Figure 2:
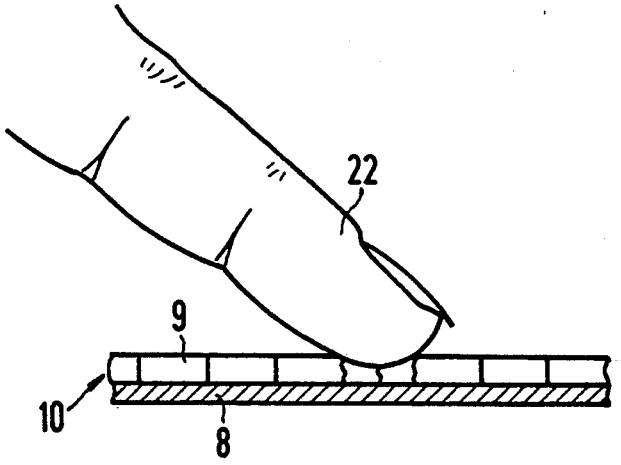
FIG. 2 is an enlarged schematic cross sectional view of a pressure or pressure and position sensor in accordance with the present invention.
Figure 3:
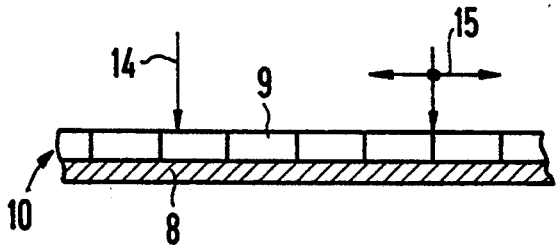
FIG. 3 is an enlarged schematic cross sectional view similar to FIG. 2 illustrating the various forces applied to the sensors.

As illustrated in FIG. 2, a pressure or pressure and position sensor 10 is a film construction, which can be actuated by a finger 22 or by a switch means. As illustrated in FIG. 3, the sensor 10 is composed of laminant polymer layers, wherein one layer is coated with interdigitalized electrodes 8 and a second layer 9 is coated with a semiconductor material. The sensor can, therefore, be employed as a sensor switch, for example an on/off switch, given the influence of a force-along arrow 14 (perpendicular to the plane of the sensor) or can be employed as a sensor control, for example as a potentiometer, given the action of moving the force along an arrow direction 15.

Figure 4:
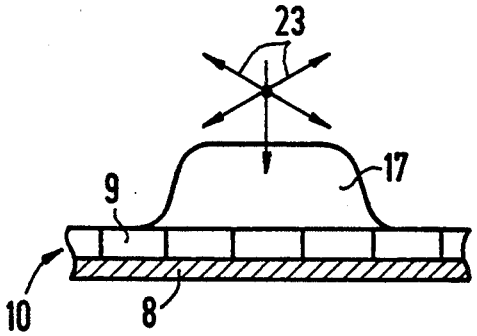
FIG. 4 is an enlarged schematic cross sectional view similar to FIG. 2 showing the possible directions for applying the forces to the sensor in accordance with the present invention.

In FIG. 4, the sensor 10 is subjected to a force 17, which is exerted via a switch means or a fingertip which acts in the direction of the force, which is capable of being in different directions according to the arrows 23. The sensor can form a control means corresponding to a joystick.

Figure 5:
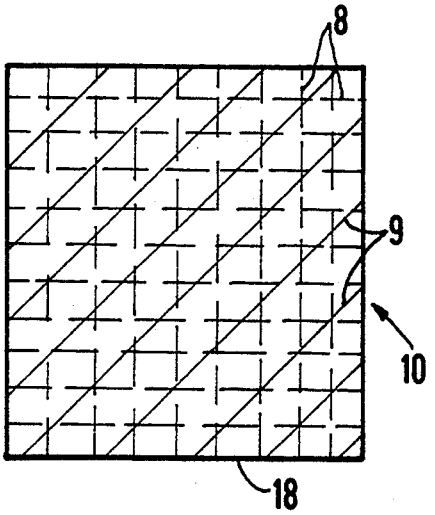
FIG. 5 is a plan view of a sensor in accordance with the present invention.

As best illustrated in FIG. 5, the sensor has the form of a matrix field 18, wherein the interdigitizing electrodes of pressure sensors are joined to one another and are arranged with a uniform distribution.

In the illustrated BTE device of FIG. 1, the electrical components, such as a microphone 2, an amplifier 3, an earphone 4 and a battery as a current source 5, are arranged in a shell-shaped housing 1. The hearing aid comprises a carrier hook 24 at one end for being worn on the ear. In the exemplary embodiment, what is referred to as an MTO switch 6 is provided for switching the hearing aid on to a microphone mode or for switching the hearing aid to a telephone mode or for switching the hearing aid off to an off position. For varying or, respectively, setting the characteristics of the amplifying unit or, respectively, of the amplifier 3, the hearing aid device comprises control elements 7 that, in particular, are formed by a plurality of pressure and/or pressure position sensors 10, or by a sensor as the matrix field 18. The sensor in the form of the matrix field 18 can also serve the purpose of programming the hearing aid device analogous to the known miniature controllers or miniature potentiometers. These control elements 7 or, respectively, the matrix field 18 are accessible via, for example, a flap or lid 19 or the like in the housing 1. In order to avoid an undesirable actuation of the sensors 7 and 18, the lid 19 can also be constructed to be held closed in a locked manner.

The actuation element of the switch means of a volume control 16 is constructed, for example, in the form of a small wheel that projects from the housing 1. For example, cam noses or projections 20, which are arranged on the switch means 16, and the two corresponding pressure sensors form the contact elements of the volume control. The invention is not limited to this exemplary embodiment. Thus, switch means can be provided in the form of rotary, slide, toggle or touch contacts, and appertaining pressure sensors can be formed from the contact elements of the switch means. In an advantageous development, the pressure sensors can, thereby, be integrated into the switch means as contact elements. Additional developments of the invention are formed, for example, by the rotary toggle seated on the housing 1, a small wheel 16, a pivot lever, a slide or the like being provided with at least one eccentric, cam 20 or nose or the like. Thus, the switch position of the respective switch means can be brought into switching positions via the eccentric cam or the like pressing against the ring-shaped, disc-shaped or strip-shaped pressure sensor 21.

In the embodiment of FIG. 1, it is also indicated with broken lines and schematically, that, for example, the pressure sensor for a large area of operation can extend over the housing section, for example at the housing exterior surface 11 of the housing wall 13, or an inside surface 12 of the housing section.

In a further embodiment, sensors 21 can be arranged on the amplifier board 3, which is arranged within the housing or on other carriers, whereby allocated actuators 6 and 20, such as, for example, the rotary, slide, toggle or contacts are provided and wherein the sensors 21 can be charged by the actuation means for triggering contact.

According to the embodiment not shown here, one or more switch pins or the like can project out of the housing of the hearing aid device for manual actuation. As switch means, they can be allocated to one or more pressure or, respectively, pressure and position sensors so that these sensors can be arranged at a carrier part provided within the housing.

An especially advantageous employment of a pressure and position sensor occurs in the condition of a joystick, as schematically illustrated in FIG. 4. Dependent on the pressure position and on the force of the pressure and the direction of the pressure, a force 17 acts on the sensor and changes in function can then be implemented at the hearing aid device.

The contacts of traditional on/off switches of known potentiometers of known miniature control elements which are susceptible to malfunction can be replaced with the pressure sensors or, respectively, pressure and position sensors employed in the hearing aid device so that the switching and control is possible, dependent on the force and/or the direction of the force acting on the pressure sensor. In a simple embodiment, components, such as joystick or a linear potentiometer or a programming field, can be created. Whereas a condition that has already been switch has its value varied in a traditional potentiometer, the linear potentiometer provided according to the present invention enables a specific value to be selected and to then process this signal. Thus, a force that selects a desired value can be exerted on a scaling of pressure sensors connected to one another. This value can be confirmed by intensified pressure, for example a signal processing can occur. Particular advantages of this sensor is that the hearing aid device can be fashioned extremely small and worn at the head occur on the basis of the embodiment of the sensors protected against environmental influences, due to a considerable space saving on the actuation surface, since the sensors lie close to one another, than would be possible given the individual keys of a display. In that way, the control values can be more precisely selected, particularly nearly with infinite variation, this being of great significance for setting and programming a device. Whereas, given pressure sensors, the semiconductor material 9 switches the interdigital electrodes 8 more or less parallel, the linear potentiometers constructed of pressure and position sensors carry out two measurements only when touched with pressure. Two types of connections are available. One type corresponds to the position of the exerted force along a strip and the other measures the strength of the exerted force. Clocking these two terminals allows multiplexed, independent measurements of the force/position that recognizes changes in the position up to 0.05 mm. The three-layer X-Y-Z digitalizer pad fashioned of the sensor supplies a multiplexed force/position output in one plane. The measured position can be an arbitrary set of coordinates in the apparatus plane. The force exerted on the sensor can be independently measured. This sensor fashioning is specifically suited for measuring the position of the punctiform object, for example of a finger tip or of a pin. For applications that require multi-point measurements, the matrix field sensor arrangement composed of a plurality of pressure sensors lies at one hand and these are arranged in a common carrier substrate. These sensors can be addressed serially or in parallel.

The employed pressure sensors are distinguished by an especially good durability and can be executed of relatively thin profiles having a thickness from 0.02 through 0.7 mm. In addition, the pressure sensors have no movable parts, and are incentive to vibrations so that it is particularly the insensitivity of the feedback of sound frequencies that is of significance for utilization in hearing aid devices. Finally, the provided pressure sensors are especially resistant to temperature, chemical and moisture, and this resistance is, again, particularly advantageous for a hearing aid device, which is to be worn in the ear. Finally, the pressure sensor can work with extremely low current so that the hearing aid device can be equipped with power saving mini batteries that are fashioned to be extremely small.

Although various minor modifications may be suggested by those versed in the art, it should be understood that we wish to embody within the scope of the patent granted hereon all such modifications as reasonably and properly come within the scope of our contribution to the art.

We claim:

1. In a hearing aid device having a housing containing electrical components, which are selected from a microphone, an amplifier, an earphone, a current source, an on/off switch, a control element, the improvements comprising sensor means being sensitive selectively to one of pressure alone and pressure and position, said sensor means being constructed as a film reactive to variable pressures and composed of laminated polymer layers, wherein one layer is connected with interdigitalizing electrodes and the appertaining other layer is coated with a semiconductor material, said sensor means being arranged on a structure element including an outside surface of the housing, the housing, and a structural element disposed within the housing, said sensor means being utilized as switches and regulators.

2. In a hearing aid device according to claim 1, wherein the sensor means forms an on/off switch.

3. In a hearing aid device according to claim 1, wherein the sensor means forms a volume control.

4. In a hearing aid device according to claim 1, wherein the sensor means forms a joystick control means, wherein the function changes at the hearing aid device can be carried out dependent on the pressure position and/or pressure force and/or pressure direction of the force acting on the sensor.

5. In a hearing aid device according to claim 1, wherein the sensor means forms a matrix field for programming the hearing aid device.

6. In a hearing aid device according to claim 5, wherein the matrix fields can be covered by a door-like element pivotably mounted on the housing so as to prevent unintentional access.

7. In a hearing aid device according to claim 1, wherein the sensor means extends over a housing section of the hearing aid for a large area operation.

8. In a hearing aid device according to claim 1, wherein a switch means is formed of rotary, toggle and touch contacts and wherein the sensor means forms a contact element for the switch means.

9. In a hearing aid device according to claim 8, wherein the switch means is a rotary toggle having a small wheel with a pivot lever being mounted for rotation in the housing, said small wheel having a portion provided with at least one eccentric cam nose engaging the sensing means which can be brought into a switching position via the cam nose.

10. In a hearing aid device according to claim 8, wherein the sensor means is integrated in a switch means as a contact element.

11. In a hearing aid device according to claim 8, wherein the switch means is a rotary toggle having a small wheel with a pivot lever and being mounted for rotation in the housing, said wheel being provided with eccentric cam nose, said sensor means being a shape selected from a ring shape, disc shape and strip shape being engageable by the eccentric cam nose during rotation of said small wheel.

12. In a hearing aid device according to claim 8, wherein the switch means includes one or more switch pins projecting from the housing for manual actuation, each of said switch pins being allocated to one or more sensor means, said sensor means being mounted on a structural member within said housing.

13. In a hearing aid device according to claim 1, wherein the sensor means are arranged on an amplifier unit disposed within said housing, said device including an allocated actuating means as one of a rotary, toggle and touch contact provided in the housing, wherein the sensor means can be charged by the actuation means for triggering said contacts.

14. In a hearing aid device having a housing containing electrical components, which are selected from a microphone, an amplifier, an earphone, a current source, an on/off switch, a control element, the improvements comprising sensor means being sensitive to pressure and position, said sensor means being constructed as a film reactive to variable pressures and composed of laminated polymer layers, wherein one layer being connected with interdigitally arranged electrodes and the appertaining other layer being coated with a semiconductor material, said sensor means being arranged on a structure element including an outside surface of the housing, the housing, and the carrier element disposed within the housing, said sensor means being selectively utilized as switches and regulators.

15. In a hearing aid device according to claim 14, wherein the sensor means forms a volume control.

16. In a hearing aid device according to claim 14, wherein the sensor means forms a joystick control means, wherein the function changes at the hearing aid device can be carried out dependent on the pressure position, pressure force and pressure direction of the force acting on the sensor.

17. In a hearing aid device according to claim 14, wherein the sensor means forms a matrix field for programming the hearing aid device.

18. In a hearing aid device according to claim 17, wherein the matrix fields can be covered by a door-like element pivotably mounted on the housing so as to prevent unintentional access.

* * * * *